United States Patent [19]

Port et al.

[11] Patent Number: 4,878,372

[45] Date of Patent: Nov. 7, 1989

[54] SHOCK-ABSORBING FLUID-ACTUATED FASTENER INSTALLATION TOOL

[75] Inventors: Gary L. Port, Woodstock; John J. Kaelin, Saugerties, both of N.Y.

[73] Assignee: Huck Manufacturing Company, Irvine, Calif.

[21] Appl. No.: 285,469

[22] Filed: Dec. 16, 1988

[51] Int. Cl.[4] ..... B21J 15/34

[52] U.S. Cl. ..... 72/391; 72/453.17

[58] Field of Search ..... 72/391, 453.17, 453.19; 29/243.58; 91/412

[56] References Cited

U.S. PATENT DOCUMENTS 4,005,598 2/1977 Ehmann et al. ..... 72/453.19
4,118,969 10/1978 Corbett ..... 72/453.17
4,347,728 9/1982 Smith ..... 72/391
4,580,435 4/1986 Port et al. ..... 72/391

*Primary Examiner*—David Jones
*Attorney, Agent, or Firm*—Lawrence J. Shurupoff

[57] ABSTRACT

A push-pull tool for setting multi-piece fasteners includes a piston that is movable back and forth within a cylinder in response to fluid forces on opposite faces of the piston. One of the fluids is an air-oil foam mixture that acts essentially as an incompressible liquid force-transmitter, while being somewhat compressible so as to absorb shock loadings associated with rapid piston movements. A check valve is included in the system to admit atmospheric air into the air-oil foam mixture, to thereby partially compensate for oil leakage that might inadvertantly take place across the piston seals.

11 Claims, 2 Drawing Sheets

SHOCK-ABSORBING FLUID-ACTUATED FASTENER INSTALLATION TOOL

BACKGROUND OF THE INVENTION

This invention relates to a push-pull tool for setting multi-piece fasteners. The invention may be viewed as an improvement or variation of the tools shown in U.S. Pat. No. 4,580,435 issued to G. L. Port et al, and U.S. Pat. No. 4,597,263 issued to Robert Corbett.

U.S. Pat. No. 4,580,435 shows a push-pull tool wherein a piston 20 is moved in one direction by air pressure applied to the right face of the piston. The piston is moved in the opposite direction by hydraulic pressure applied to the left face of the piston. In one specific instance the air pressure was 90 p.s.i., whereas the hydraulic pressure was 3800 p.s.i. (see column 3, lines 17 and 18). While the hydraulic pressure is being applied to the left face of the piston the chamber space to the right of the piston is vented to atmosphere through a clearance opening at trigger 136.

One problem with the tool shown in U.S. Pat. No. 4,580,435 is the fact that over time the high pressure hydraulic fluid tends to be drawn past the piston seals 30 and 32 into the air chamber at the right of the piston. This oil migration can cause the tool to malfunction in extreme cases. Another problem with the patented tool is a low operating pressure on the air side of the piston.

U.S. Pat. No. 4,597,263 shows a push-pull tool wherein hydraulic fluids on opposite faces of piston 74 are alternately pressurized to move the piston to the left and then to the right. The hydraulic system is provided with a pressure relief valve 64 to vent pressurized liquid to the atmosphere in response to pressure surges occurring in the system. Repeated opening of valve 64 can deplete the liquid in the system, thereby degrading the tool performance.

SUMMARY OF THE INVENTION

The present invention relates to a push-pull tool wherein the actuating piston is moved in one direction by a pressurized liquid. The piston is moved in the opposite direction by a pressurized air-oil foam mixture. A check valve is incorporated into the system to admit additional air into the foam mixture in the event of pressure losses incident to leakage of oil across the piston seals. The air-oil foam can be pressurized to provide satisfactory force on the piston, even after considerable atmospheric air has been assimilated into the air-oil foam mixture.

The invention seeks to provide a comparatively inexpensive tool wherein considerable oil leakage across the seals can be tolerated without tool malfunction or excessive loss of operating pressure.

THE DRAWINGS

DESCRIPTION OF A PREFERRED EMBODIMENT OF THE INVENTION

Figures 1, 2:
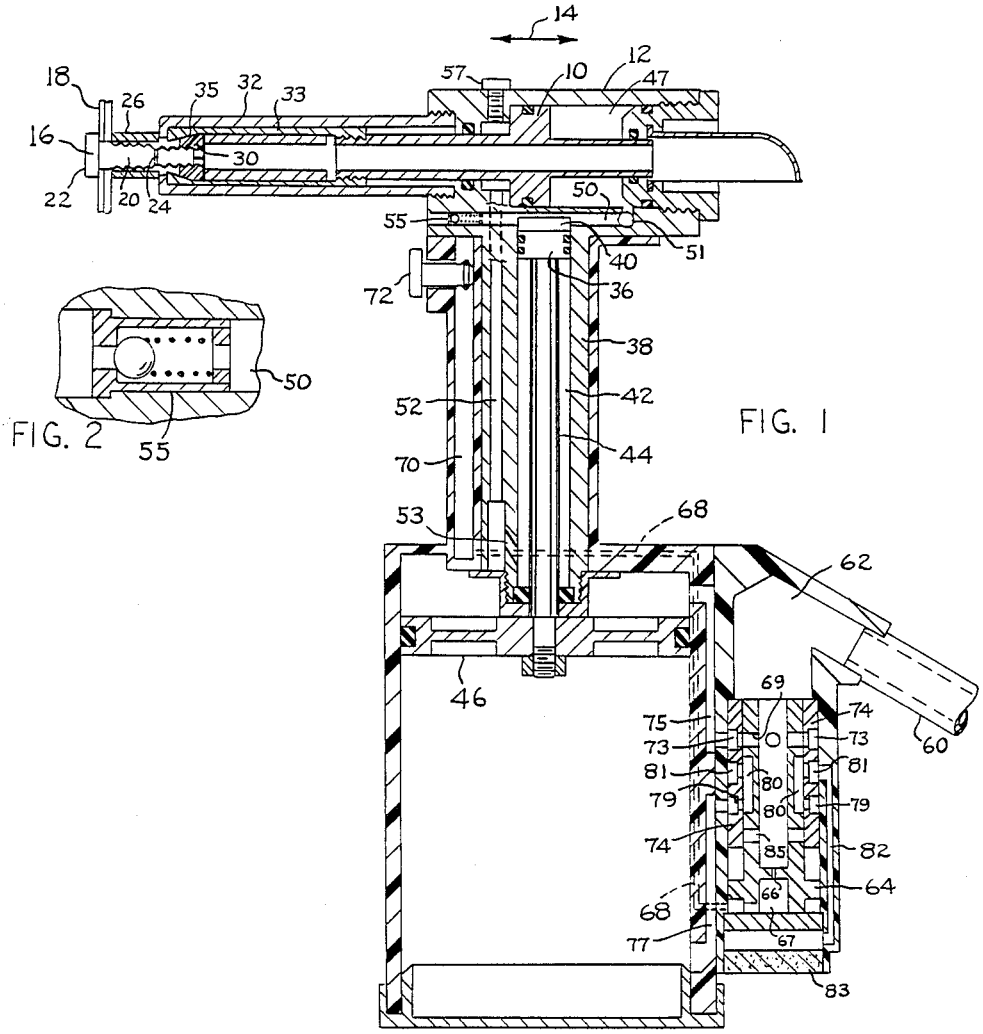
FIG. 1 is a sectional view taken through a tool embodying the invention.
FIG. 2 is a fragmentary sectional view taken through a structural detail used in the FIG. 1 tool.
Figure 3:
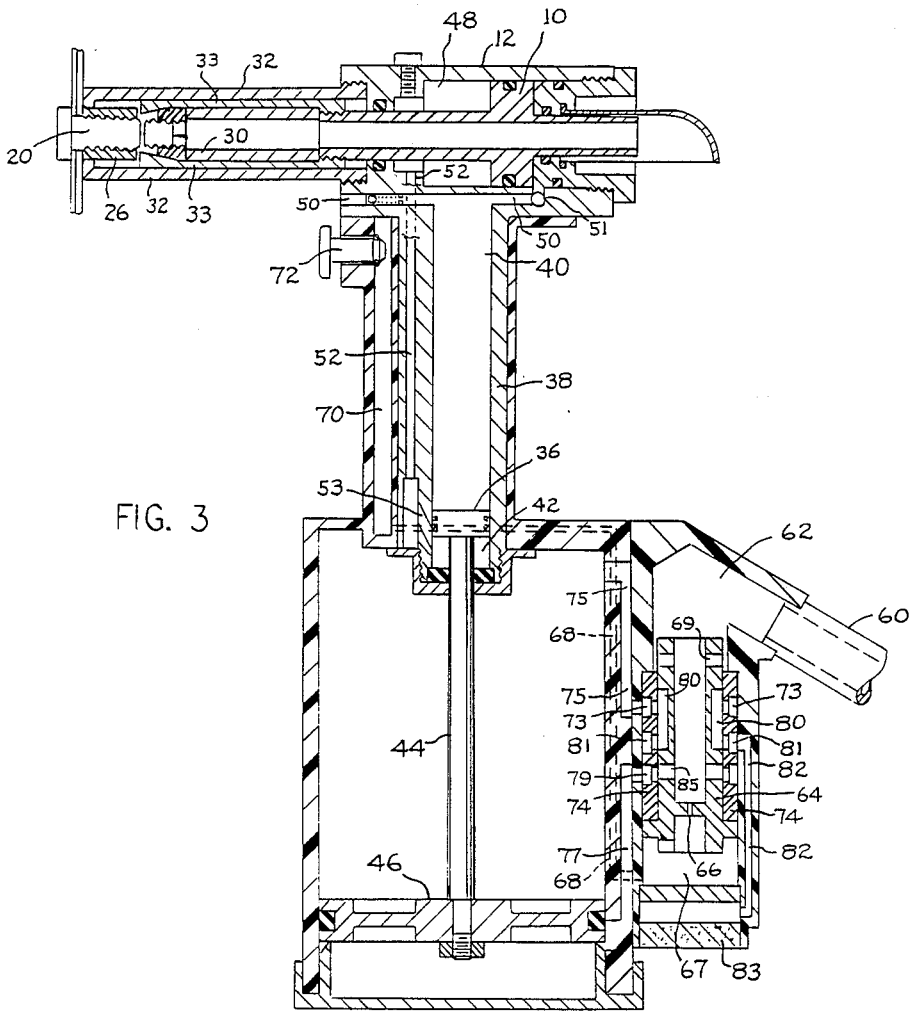
FIG. 3 is a sectional view taken in the same direction as FIG. 1, but illustrating the tool in a different condition of adjustment.

FIG. 1 shows a push-pull tool embodying the invention. The tool comprise a piston 10 slidably positioned in a cylinder 12 for reciprocal movement in the arrow 14 directions. FIG. 1 shows the tool at the initiation of a fastener setting operation; piston 10 is just starting to move in a left-to-right direction. FIG. 3 shows the tool as piston 10 is just starting the return stroke in a right-to-left direction.

The push-pull tool is designed to permanently affix a multipiece fastener 16 to work pieces 18. The tool-fastener relationship is the same as the relationship shown in U.S. Pat. No. 4,347,728 issued to W. J. Smith. The fastener includes a pin 20 having a head 22 positioned against one face of the work piece assembly. The shank portion of the pin extends through aligned holes in the work pieces. Annular circumferential grooves are formed in the pin surface. At a point near its right end the pin may have a deeper breakneck groove 24 extending therearound.

A collar 26 is loosely positioned on the pin to engage the left face of the work piece assembly. The aforementioned piston 10 is connected to a tubular collet member 33 whose left end is internally formed into an annular cam surface 35. A resilient jaw structure 30 is positioned within collet member 33, in a manner more particularly described in above-mentioned U.S. Pat. No. 4,347,728.

Cylinder 12 is connected to a tubular anvil 32, whose left end face is sized to engage the opposing end face of collar 26. With piston 10 in the FIG. 1 position, rightward motion of the piston (relative to cylinder 12) causes anvil 32 to forcibly engage the end face of collar 26 as piston 10 exerts a pulling force on pin 20 to prevent relative leftward motion of collar 26 away from the anvil. Anvil 32 advances into and along the collar to cause the inner surface of the collar to be swaged into the grooves in pin 20, thereby rigidly locking the multipiece fastener to work piece 18.

As anvil 32 engages the face of the workpiece assembly it encounters increased resistance to leftward motion. Jaws 30 remain clamped to the right end of pin 20, such that anvil 32 and jaw structure 30 cooperatively apply a high tensile load on pin 20, sufficient to break the pin at breakneck groove 24. The severed end of pin 10 is ejected to the right through a central passage extending through piston 10. FIG. 3 shows the pin broken apart (after completion of the collar swaging operation).

When piston 10 has moved rightwardly to the FIG. 3 position a manual trigger 72 is operated so that the space below air piston 46 is pressurized. The air piston moves upwardly to cause piston 36 to pump fluid into the space to the right of piston 10. Piston 10 thus moves to the left back to the starting position shown in FIG. 1.

The present invention primarily concerns a fluid pressure system for reciprocating piston 10 within cylinder 12. The system comprises a fluid pumping piston 36 slidably positioned in an elongated pumping cylinder 38. Piston 36 subdivides cylinder 38 into an upper fluid reservoir 40 and a lower fluid reservoir 42. A piston rod 44 extends downwardly through reservoir 44 to a fixed connection with an enlarged air piston 46. The two reservoirs vary in volume, depending on the position of piston 36.

Fastener actuator piston 10 subdivides cylinder 12 into a right hand chamber 47 (FIG. 1) and a left hand chamber 48 (FIG. 3). Fluid reservoir 40 is connected to chamber 47 via a horizontal cylindrical passage 50. Fluid reservoir 42 is connected to chamber 48 via an elongated vertical passage 52; an angled port 53 connects reservoir 42 to passage 52.

Chamber 47, passage 50 and reservoir 40 form a closed system for containment of an air-oil foam mixture; a check valve 55 in passage 50 is used to charge air into the closed system. Oil is charged into the system through a filler opening 51. Chamber 48, passage 52 and reservoir 42 form a second closed system for containment of hydraulic fluid (oil). A removable threaded fastener provides a filler opening 57 in cylinder 12 to charge oil into the second system.

With the systems charged with fluids as above described, the pumping piston 36 can be operated to pump fluids into chambers 47 and 48 thereby driving piston 10 back and forth in cylinder 12. Downward motion of piston 36 from the FIG. 1 position to the FIG. 3 position causes oil to be pumped from reservoir 42 through passage 52 into chamber 48. At the same time, an air-oil foam mixture is withdrawn from chamber 47 for movement into reservoir 40. Upward motion of piston 36 from the FIG. 3 position to the FIG. 1 position causes an air-oil foam mixture to be pumped from reservoir 40 through passage 50 into chamber 47. At the same time, oil is withdrawn from chamber 48 through passage 52 into reservoir 42. The motive force for piston 36 movement is air piston 46.

The system defined by chamber 47 and reservoir 40 is sized so that chamber 47 displacement is less than the reservoir 40 displacement. Thus, when piston 10 and piston 36 moves from the FIG. 3 positions to the FIG. 1 positions the volumetric increase in chamber 47 is less than the volumetric decrease in reservoir 40. Similarly, when piston 10 moves and piston 36 from the FIG. 1 positions to the FIG. 3 positions the volumetric decrease in chamber 47 is less than the volumetric increase in reservoir 40. The volumetric displacement differential is used to obtain an air-oil foam mixture in the closed system.

Chamber 47 and reservoir are initially charged with oil (through filler opening 51) with piston 36 in the FIG. 1 position; a sealer plug is applied to the filler opening after the oil-changing operation. At this time there is no air in the closed system. However, by cycling piston 36 up and down in cylinder 38 it is possible to draw air into the system through check valve 55. During the first downstroke of piston 36 the system volume increases so that atmospheric air is drawn through check valve 55 to compensate for the volume change; on the upstroke of piston 36 check valved 55 closes so that the drawn-in air is retained within the system. After a few cycles of piston 36 the system will be air-oil filled; thereafter the system will remain closed unless there should be fluid escapage from the system across piston 10 or piston 36.

Chamber 47 displacement is preferably about twenty-percent less than the reservoir 40 displacement. Therefore, on a volumetric basis the air-oil foam mixture will be about 80% oil and 20% air. The displacement differential can be somewhat greater, or somewhat less, than twenty percent, e.g. 30% or 10%. However, the chamber-reservoir dimensions must be such that the foam mixture is predominantly liquid (not gaseous).

Chamber 48, passage 52 and reservoir 42 form a constant volume system, wherein chamber 48 has the same volumetric displacement as reservoir 42. The oil in this system acts as an essentially non-compressible liquid force-transmitter. In contrast, the air-oil foam mixture in the other closed system acts as a slightly compressible force-transmitter.

Use of an air-oil foam mixture is advantageous in that shock forces tend to be absorbed. For example, during movement of piston 10 from the FIG. 1 position to the FIG. 3 position inertia forces tend to move piston 10 rightwardly at a high rate, especially at the instant when pin 20 is being broken. The resulting compression of the air in the air-oil foam mixture tends to exert a snubber force on piston 10, thereby relieving some of the shock loading. During leftward movement of piston 10 from the FIG. 3 position in the FIG. 1 position the air-oil foam mixture is under a high compression loading. The foam acts substantially as a liquid, but with some compression due to the air contained therein. Compression of the foam minimizes rebound effects after the piston reaches the FIG. 1 position.

Use of an air-oil foam mixture is also advantageous in that oil leakage past the piston seals has a lessened effect on system performance. Oil leakage of a significant magnitude will allow atmospheric air to be drawn into the system through check valve 55. Thereafter the system will operate in a somewhat softer (cushioned) mode, however, it will still be operational. Some air may migrate into the other side of the system, i.e. chamber 48 and reservoir 42, but such air migration will not cause a malfunction unless there is a substantial leakage condition.

The described tool has approximately the high force operational mode of a hydraulic tool, but with the shock-cushioning action of an air tool. Check valve 55 provides a path for make-up air into the tool. The tool does not require a pressure relief valve similar to valve 64 in aforementioned U.S. Pat. No. 4,597,263.

Piston 36 can be operated by any suitable power source. FIGS. 1 and 3 show the power source as an air piston-cylinder unit constructed generally similar to the corresponding unit in U.S. Pat. No. 4,580,435. Operation of the piston-cylinder unit will be described in a very brief fashion.

Piston 36 is connected to air piston 46, such that a high pressure on the upper face of piston 46 moves the two pistons from the FIG. 1 condition to the FIG. 3 condition. Conversely, a high air pressure on the lower face of piston 46 moves the two pistons back to the FIG. 1 condition. The air pressures on piston 46 are controlled by a spool valve 64 and manual trigger 72.

Referring to FIG. 1, air at 90 p.s.i. is supplied through hose 60 to space 62 above spool valve 64. Air flows through restriction 66 into space 67 below the spool valve 64. Space 67 may be vented to atmosphere through a passage system that includes a passage 68 (shown in dashed lines) and a connected passage 70. When manual pushbutton trigger 72 is depressed to the FIG. 1 position air in passage 70 is vented through a clearance space around the trigger plunger. With space 67 vented to atmosphere through the described passage system, spool valve 64 will be in the FIG. 1 position.

Pressurized air will flow from space 62 through holes 69 in spool valve 64 into an annular groove 73 in annular insert 74. A passage 75 conducts the pressurized air into the space above air piston 46, thereby forcing the piston to move downwardly from the FIG. 1 position to the FIG. 3 position. The space below piston 46 is vented through a passage system that comprises passage 77, annular groove 79 in insert 74, annular groove 80 in spool valve 64, annular groove 81 in insert 74, passage 82, and porous muffler 83. The system is generally similar to that shown in U.S. Pat. No. 4,580,435.

Air piston 46 can be moved upwardly from the FIG. 3 position to the FIG. 1 position by releasing the manual force on trigger 72. Space 67 below spool valve 64 is thus sealed so that air pressure in space 67 lifts the spool valve to the FIG. 3 position. Pressurized air is supplied to the space below piston 46 through a passage system that includes ports 85 in spool valve 64, groove 79 and passage 77. Air is vented from the space above piston 46 through a passage system that includes passage 75, groove 73 in insert 74, groove 80 in spool valve 64, groove 81, passage 82, and muffler 83.

The air cylinder unit and control valve system is not part of the present invention. The invention is concerned with the fluid system for powering piston 10. Of special importance is the air-oil foam mixture in the chamber system defined by chamber 47, passage 50, and reservoir 40. Check valve 55 is used to admit atmospheric air into passage 50, to thus provide the air-oil foam mixture.

The drawings show one particular structural form embodying the invention. Other structural forms are possible.

What is claimed is:

1. A push-pull tool for setting fasteners comprising:

a tool actuator cylinder;

a fastener actuator piston slidably positioned in the actuator cylinder to subdivide the cylinder into first and second chambers;

first and second separate fluids; said first fluid being a liquid; said second fluid including a liquid;

pump means having a forward stroke for pumping the first fluid into the first chamber while withdrawing the second fluid from the second chamber, to thereby move the piston in a first direction;

said pump means having a return stroke for pumping the second fluid back into the second chamber while withdrawing the first fluid from the first chamber, to thereby move the piston in a second direction; and means on said tool for admitting gas into said second fluid to thereby form a gas-liquid foam mixture.

2. The tool of claim 1 wherein said gas-fluid foam mixture is an air-oil foam.

3. The tool of claim 1 wherein the gas-liquid foam mixture is between 70% and 90% liquid, with the remainder being gas.

4. The tool of claim 1 wherein the gas-liquid mixture is approximately 80% liquid and 20% gas.

5. The tool of claim 1 wherein said means for admitting gas into said second fluid comprises a check valve means operable to admit external gas into the second fluid in the event that the second chamber should experience a lower pressure than the external pressure.

6. A push-pull tool for setting fasteners comprising:

a first tool actuator cylinder;

a fastener actuator piston slidably positioned in the actuator cylinder to subdivide the actuator cylinder into first and second chambers;

pump means comprising a pumping second fluid pumping cylinder, and a pumping piston slidably positioned in said pumping cylinder to subdivide said pumping cylinder into a first fluid reservoir and a second fluid reservoir;

first passage means connecting the first chamber to the first fluid reservoir;

second passage means connecting the second chamber to the second fluid reservoir;

first and second separate fluids;

said first fluid being a liquid located within the first chamber and associated reservoir;

said second fluid including a liquid and being located within the second chamber and associated second reservoir;

means in said second passage for admitting gas into said second fluid to thereby form a gas-liquid foam mixture;

and means for moving the pumping piston through a forward stroke wherein the first fluid is pumped out of the first reservoir into the first chamber and the second fluid is pumped out of the second chamber into the second reservoir to move the actuator piston in a first direction, and a return stroke wherein the first fluid is pumped back from the first chamber into the first reservoir and the second fluid is pumped back from the second reservoir into the second chamber to move the actuator piston in a second direction opposite said first direction.

7. The tool of claim 6 wherein said means for admitting gas into said second fluid comprises a check valve means for admitting atmospheric air into the second passage means in the event that the pressure in the second passage means should drop below atmospheric pressure.

8. The tool of claim 6 wherein the fluid displacement of the second chamber is less than the fluid displacement of the second reservoir.

9. The tool of claim 6 wherein the fluid displacement of the second chamber is less than the fluid displacement of the second reservoir;

said means for admitting gas into said second fluid comprises a check valve means operable to atmospheric air into the second passage means in accordance with the difference in fluid displacement of the second chamber and second reservoir.

10. The tool of claim 9 wherein the displacement of the second chamber is between 10% and 30% less than the displacement of the second reservoir.

11. The tool of claim 10 wherein the displacement of the second chamber is approximately 20% less than the displacement of the second reservoir.

* * * * *

UNITED STATES PATENT AND TRADEMARK OFFICE

CERTIFICATE OF CORRECTION

PATENT NO. : 4,878,372

DATED : November 7, 1989

INVENTOR(S) : Gary L. Port and John J. Kaelin

It is certified that error appears in the above-identified patent and that said Letters Patent is hereby corrected as shown below:

Column 1, line 68, "comprise" should read -- comprises --.

Column 3, line 30, "moves" should read -- move --.

Column 3, line 39, after "reservoir" insert -- 40 --.

Column 3, line 49, "valved" should read -- valve --.

Column 6, line 4, claim 6, before "fluid" delete "second".

Column 6, line 46, claim 9, before "atmospheric" insert -- admit --.

Column 3, line 33, "when piston 10 moves" should read --when piston 10 and piston 36 move--.

Signed and Sealed this

Twenty-fifth Day of June, 1991

*Attest:*

HARRY F. MANBECK, JR.

*Attesting Officer*

*Commissioner of Patents and Trademarks*